US005881810A

United States Patent [19]

Reinholdt et al.

[11] Patent Number: 5,881,810

[45] Date of Patent: Mar. 16, 1999

[54] CENTRALIZER

[75] Inventors: Bernd Reinholdt, Hannover-Bothfeld; Jorg Lorenz, Burgwedel, both of Germany; Arnold Stokka, Sandnes, Norway

[73] Assignee: Weatherford/Lamb, Inc., Houston, Tex.

[21] Appl. No.: 768,372

[22] Filed: Dec. 17, 1996

[30] Foreign Application Priority Data

Aug. 24, 1996 [GB] United Kingdom ..... 9617789

[51] Int. Cl.[6] ..... E21B 17/10

[52] U.S. Cl. ..... 166/241.7

[58] Field of Search ..... 166/241.6, 241.7, 166/173

[56] References Cited

U.S. PATENT DOCUMENTS

| | | | |
|---|---|---|---|
| H1192 | 6/1993 | Keller | 166/241.6 |
| 2,312,600 | 3/1943 | Steps . | |
| 2,352,412 | 6/1944 | Sandstone | 255/28 |
| 2,602,512 | 7/1952 | Baker . | |
| 2,622,684 | 12/1952 | Kluck | 166/4 |
| 2,659,439 | 11/1953 | Baker . | |
| 2,865,605 | 12/1958 | Chadderon | 255/28 |
| 2,973,996 | 3/1961 | Self . | |
| 3,049,382 | 8/1962 | Ell . | |
| 3,080,926 | 3/1963 | Remp, Jr. | 166/241 |
| 3,320,004 | 5/1967 | Garrett | 308/4 |
| 3,666,013 | 5/1972 | Saadeh | 166/241 |
| 3,747,700 | 7/1973 | Rilling | 175/323 |
| 3,762,472 | 10/1973 | Alexander, Jr. | 166/241 |
| 3,933,395 | 1/1976 | Evans | 308/4 A |
| 3,938,853 | 2/1976 | Jurgens et al. | 308/4 A |
| 4,011,918 | 3/1977 | Jurgens | 175/325 |
| 4,033,187 | 7/1977 | Nicolas | 73/155 |
| 4,039,026 | 8/1977 | Yonker | 166/117.5 |
| 4,043,410 | 8/1977 | Bennett et al. | 175/323 |
| 4,050,514 | 9/1977 | Prenn | 166/176 |

(List continued on next page.)

FOREIGN PATENT DOCUMENTS

| | | |
|---|---|---|
| 0102197A2 | 3/1984 | European Pat. Off. . |
| 84 307031 | 10/1984 | European Pat. Off. . |
| 1375773 | of 0000 | United Kingdom . |
| 682362 | 12/1950 | United Kingdom . |
| 844276 | 7/1958 | United Kingdom . |
| 851036 | 7/1959 | United Kingdom . |
| 2201176 | 2/1988 | United Kingdom . |
| 2285649 | 7/1995 | United Kingdom . |
| 2290331 | 12/1995 | United Kingdom . |
| WO 9108374A2 | 6/1991 | WIPO . |
| WO 9609459A1 | 3/1996 | WIPO . |

OTHER PUBLICATIONS

"American Coldset Corp.," from The Story of the American Oil Industry, 1981, pp. 360–361.

"Laboratory Drill Pipe Protector Tests," Garkasi et al., ASME, 1994.

"New Spiral Solid Stand–Off Centralizers," Ray Oil Tool Company, 1995.

"Spiral Rigid Centralizers," Weatherford, 1990.

"Primary Cementing," Baker Oil Tools, p. 20, 1989.

"Proven Primary Cementing Tools," Frank's Int'l, 1994.

"Float Equipment & Cementing Aids," Baker Packers, 1984.

Trico Industries, Inc., 1982–83 Catalog, pp. 8222–8224.

BJ Rubber Products, Byron Jackson, Inc., p. 902, 1984.

"Analysis of Cementing Turbulators," Wells et al, SPE 19542, 1989.

"Milam Turbulators," Turbeco, Inc., 1989.

Search Report, UK Applic. No. GB 9617789.4 Counterpart of this present US case.

*Primary Examiner*—William Neuder
*Attorney, Agent, or Firm*—Guy McClung

[57] ABSTRACT

A centralizer comprises two annular bands which are spaced apart by a plurality of members extending there-between. The members are inclined to the longitudinal axis of the centralizer by an angle a of typically 30° to 45°.

5 Claims, 1 Drawing Sheet

U.S. PATENT DOCUMENTS

| | | | |
|---|---|---|---|
| 4,077,470 | 3/1978 | Dane | 166/244 R |
| 4,206,808 | 6/1980 | Kreft | 166/241 |
| 4,275,935 | 6/1981 | Thompson et al. | 308/4 A |
| 4,436,158 | 3/1984 | Carstensen | 166/377 |
| 4,506,219 | 3/1985 | Lee | 324/221 |
| 4,531,582 | 7/1985 | Muse et al. | 166/241.7 |
| 4,549,613 | 10/1985 | Case | 175/325 |
| 4,658,896 | 4/1987 | Milam | 166/241 |
| 4,787,458 | 11/1988 | Langer | 166/380 |
| 4,794,986 | 1/1989 | Langer | 166/241 |
| 4,875,524 | 10/1989 | Bradley et al. | 166/241 |
| 4,984,633 | 1/1991 | Langer et al. | 166/241 |
| 5,095,981 | 3/1992 | Mikolajczyk | 166/241.6 |
| 5,097,905 | 3/1992 | Goodwin | 166/378 |
| 5,238,062 | 8/1993 | Reinholdt | 166/241.7 |
| 5,566,754 | 10/1996 | Stokka | 166/241.6 |
| 5,575,333 | 11/1996 | Lirette et al. | 166/241.1 |
| 5,727,627 | 3/1998 | Squires | 166/241.3 |
| 5,758,723 | 6/1998 | Saucier et al. | 166/55.8 |
| 5,778,976 | 7/1998 | Murray | 166/241.6 |
| 5,785,125 | 7/1998 | Royer | 166/380 |

CENTRALIZER

FIELD OF THE INVENTION

This invention relates to centralizers for use in the construction of oil and gas wells.

BACKGROUND OF THE INVENTION

During the construction of oil and gas wells a borehole is drilled into the ground. A string of casing is then lowered down the borehole and the annular space between the casing and the borehole filled with cement.

It is important to ensure that the casing is held centrally in the borehole during cementation and it is usual to provide the casing with a plurality of centralizers which act between the casing and the borehole.

Various types of centralizer are known. One type comprises two annular bands which are spaced apart by a plurality of longitudinally extending members. These members can comprise spring bows or rigid members. They share the common feature that, in use, the members extend parallel to the longitudinal axis of the casing on which they are mounted.

Another type of centralizer, often referred to as a "solid centralizer", comprises a casting having a solid central section on which are formed a plurality of fins. In some embodiments the fins are disposed so that, in use, they extend parallel to the longitudinal axis of the casing on which they are mounted. In other embodiments the fins are disposed at an angle so that, in use, when circulating fluid is pumped through the annular space between the casing and the borehole prior to introducing the cement the circulating fluid is encouraged to swirl around the casing. In many situations this also enhances the distribution of cement when it is subsequently injected into the annular space.

SUMMARY OF THE PRESENT INVENTION

The present invention provides a centralizer which comprises a pair of annular bands which are spaced apart by a plurality of members extending therebetween, characterised in that said members are inclined to the longitudinal axis of said centralizer.

Preferably, the members have a radially inner surface which is substantially flush with the radially inner surface of said annular bands. This feature, whilst not absolutely essential, is most highly desirable since it encourages the desired swirling action.

The members themselves may be solid or hollow and may be of any convenient cross-section.

In a particularly preferred embodiment the members are of curved cross-section.

Advantageously, said members are tapered towards each end.

Advantageously, the members may have a strength so that, in use, if the centralizer is subjected to a lateral load of from 5 to 20 tonnes, and more preferably from 5 to 15 tonnes, they will substantially irreversibly collapse against the casing. This concept is more fully disclosed in Applicants PCT Publication No. WO 96/09459.

If desired, the annular bands may be formed in two separate parts which may be bolted together around a casing or which may be hinged together.

BRIEF DESCRIPTION OF THE DRAWINGS

For a better understanding of the present invention reference will now be made, by way of example, to FIG. 1 of the accompanying drawing which shows a perspective view of one embodiment of a centralizer in accordance with the present invention mounted on a length of casing.

DETAILED DESCRIPTION OF THE PREFERRED EMBODIMENT

Figure 1:
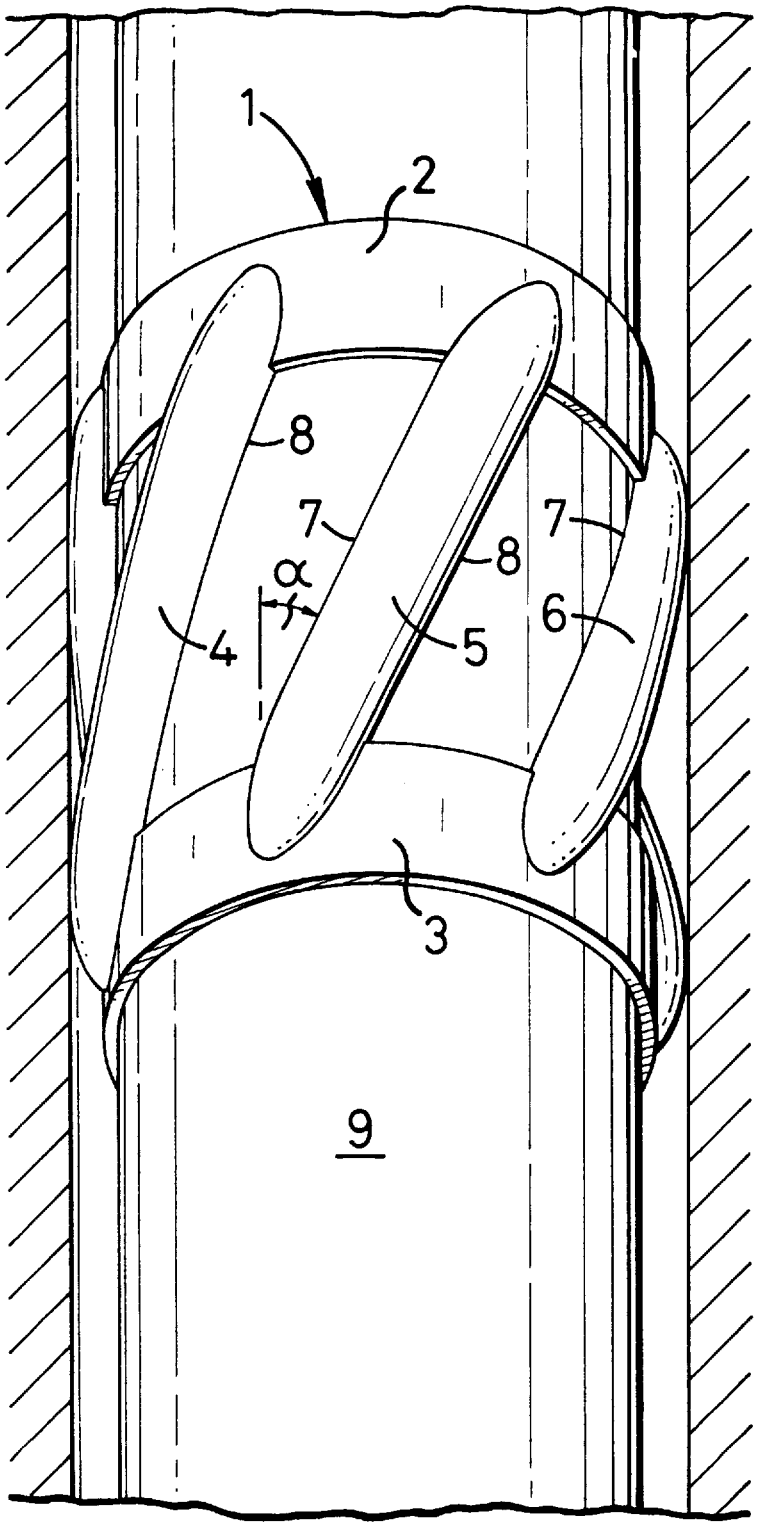

Referring to FIG. 1, there is shown a centralizer which is generally identified by the reference numeral 1.

The centralizer 1 comprises two annular bands 2 and 3 which are spaced apart by eight members three of which 4, 5 and 6 are clearly visible.

Each member 4, 5, 6 is inclined at an angle $\alpha$ of from between 20° to 60° and preferably from about 30° to 45° to the longitudinal axis of the centralizer 1.

Each member 4, 5, 6 has skirt portions 7, 8 which extend radially inwardly and finish flush with the radially inner surface of the two annular bands 2 and 3.

In use, the centralizer 1 is slid over a tubular 9. The centralizer 1 may be secured by stop collars (not shown) placed above and below the centralizer or by bolts (not shown) which pass through the annular bands 2 and 3 and bear against the casing 9. Alternatively, the centralizer 1 may be glued to the casing 9.

Each member 4, 5, 6 comprises a thin sheet of steel which is about 3 mm in thickness and is shaped into a curve. Accordingly, each member 4, 5, 6 is hollow. Each member 4, 5, 6 is also tapered both radially and circumferentially towards each end to facilitate movement of the centralizer 1 in the borehole.

In use, a plurality of centralizers similar to centralizer 1 are secured to a string of casing which is then lowered down a borehole. When the casing is in place circulating fluid is pumped down the inside of the casing and travels upwardly in the annular space between the casing 9 and the borehole. As the circulating fluid passes upwardly over the annular band 3 between the members it is diverted sideways. As it passes over the upper edge of the annular band 3 a turbulent rolling action is initiated which is amplified as the circulating fluid passes over the annular band 2. The combined swirling and rolling action provides an extremely effective cleaning and scouring action which is highly desirable.

After the annular space between the casing 9 and the borehole has been prepared cement is pumped down the casing and up into the annular space and allowed to set in the conventional manner.

Occasionally, part of the borehole will collapse when running casing. The usual procedure when this occurs is to withdraw the casing, make good the problem as necessary and reinstate the casing. Although the casing can usually be withdrawn without too much difficulty the forces imposed on traditional centralizers often result in their disintegration with the result that broken parts of centralizers remain in the borehole. This is most undesirable. Applicants PCT Publication No. WO 96/09459 addresses this problem by providing a centralizer with members which have sufficient strength to centralize the casing but which will collapse if withdrawn through a relatively rigid constriction. The underlying principle is that it is better to replace a permanently deformed centralizer at the surface rather than to leave parts of a disintegrated centralizer in the borehole. Typically, the members should substantially completely collapse when subjected to a lateral load of from 5 to 15 tonnes with 11 tonnes being currently used for design purposes for most occasions.

What is claimed is:

1. A centralizer for centralizing a pipe in a casing, which centralizer has a longitudinal axis and comprises a pair of annular bands having a radially inner surface and which are longitudinally spaced apart by a plurality of hollow curved members extending therebetween, each curved member having two spaced-apart ends, wherein said curved members are of curved cross-section and inclined to the longitudinal axis of said centralizer at an angle of between about 20° to 60° to the longitudinal axis of the centralizer, each curved member extending radially inwardly and having an inner surface flush with the radial Inner surfaces of the annular bands and each said curved member having a length and curved along said length to its entire extent, said curved members tapered both radially and circumferentially towards each of their two spaced apart ends to facilitate movement of the centralizer.

2. A centralizer as claimed in claim 1 wherein said members are made of thin steel about 3 mm. thick.

3. A centralizer as claimed in claim 1 wherein said curved members will, in use, substantially irreversibly collapse against said casing when subjected to a lateral load of from 5 to 15 tonnes.

4. A centralizer as claimed in claim 1 wherein said annular bands are formed in two separate parts which can be mounted circumjacent said casings.

5. A centralizer for centralizing a pipe in a casing, which centralizer has a longitudinal axis and comprises a pair of annular bands having a radially inner surface and which are longitudinally spaced apart by a plurality of hollow curved members extending therebetween, each curved member having two spaced-apart ends, wherein said curved members are of curved cross-section and inclined to the longitudinal axis of said centralizer at an angle of between about 20° to 60° to the longitudinal axis of the centralizer each curved member extending radially inwardly and having an inner surface flush with the radial inner surfaces of the annular bands and said curved members having a length and curved along said length to its entire extent, said curved members tapered both radially and circumferentially towards each of their two spaced-apart ends to facilitate movement of the centralizer, wherein said curved members will, in use, substantially irreversibly collapse against said casing when subjected to a lateral load of from 5 to 15 tonnes, and wherein said annular bands are formed in two separate parts which can be mounted circumjacent said casing.

* * * * *